US007380573B2

(12) United States Patent
Reiter

(10) Patent No.: US 7,380,573 B2
(45) Date of Patent: Jun. 3, 2008

(54) METHOD OF PRODUCING ON NEEDLE WEAVING LOOMS A WOVEN RIBBON WITH THE SAME EDGES IN TERMS OF WEAVING

(75) Inventor: Erich Reiter, Eschach (DE)

(73) Assignee: Kikuchi Kogyo Co., Ltd., Shizuoka (JP)

( * ) Notice: Subject to any disclaimer, the term of this patent is extended or adjusted under 35 U.S.C. 154(b) by 0 days.

(21) Appl. No.: 11/296,026

(22) Filed: Dec. 7, 2005

(65) Prior Publication Data

US 2006/0117807 A1 Jun. 8, 2006

(30) Foreign Application Priority Data

Dec. 7, 2004 (DE) ..... 10 2004 059 780

(51) Int. Cl.

| | |
|---|---|
| ***D03D 47/42*** | (2006.01) |
| ***D03D 47/20*** | (2006.01) |
| ***D03D 35/00*** | (2006.01) |
| *D03D 47/44* | (2006.01) |

(52) U.S. Cl. ..... 139/447; 139/432; 139/431; 139/22; 139/135; 139/195

(58) Field of Classification Search ..... 139/22, 139/135, 23, 136, 195, 430–432, 434, 440, 139/442

See application file for complete search history.

(56) References Cited

U.S. PATENT DOCUMENTS

| | | | | |
|---|---|---|---|---|
| 3,090,405 | A * | 5/1963 | Dewas | 139/430 |
| 4,059,133 | A * | 11/1977 | Diesner et al. | 139/440 |
| 4,313,473 | A * | 2/1982 | Reiter | 139/432 |
| 4,431,035 | A * | 2/1984 | Young et al. | 139/383 R |
| 4,436,121 | A * | 3/1984 | Cheynet | 139/116.1 |
| 4,577,665 | A * | 3/1986 | Diesner | 139/431 |
| 4,984,608 | A * | 1/1991 | Bertsch et al. | 139/434 |
| 5,141,031 | A * | 8/1992 | Baurmeister | 139/383 R |
| 5,299,603 | A * | 4/1994 | Reiter | 139/431 |
| 5,878,787 | A * | 3/1999 | Speich | 139/22 |
| 5,954,098 | A * | 9/1999 | Speich | 139/431 |
| 6,918,411 | B2 * | 7/2005 | Berger et al. | 139/434 |
| 7,066,214 | B2 * | 6/2006 | Speich et al. | 139/442 |
| 7,073,540 | B2 * | 7/2006 | Zorini | 139/449 |
| 2002/0189701 | A1 * | 12/2002 | Berger et al. | 139/383 R |
| 2005/0161104 | A1 * | 7/2005 | Reiter | 139/383 R |

FOREIGN PATENT DOCUMENTS

| | | |
|---|---|---|
| DE | 803 989 | 4/1951 |
| WO | WO 01/77424 | 10/2001 |

* cited by examiner

*Primary Examiner*—Robert H Muromoto
(74) *Attorney, Agent, or Firm*—Greer, Burns & Crain, Ltd.

(57) ABSTRACT

A woven ribbon, preferably a vehicle safety belt strap, is produced on a needle weaving loom. The weft yarns alternately picked from right and left are crocheted with the respective preceding weft already picked.

9 Claims, 4 Drawing Sheets

PRIOR ART (A)

METHOD OF PRODUCING ON NEEDLE WEAVING LOOMS A WOVEN RIBBON WITH THE SAME EDGES IN TERMS OF WEAVING

FIELD OF THE INVENTION

The present invention relates to a woven ribbon including a safety belt used in a vehicle and a method for producing the same.

BACKGROUND OF THE INVENTION

It is important that ribbons, which are used in the technical field, in particular with vehicle safety belts, remain dimensionally stable in use.

Vehicle safety belts which are continually abraded by the user in running over the deflection pulley and the socket tongue tend to deform, in particular when they are produced on modern needle weaving looms and thus have uneven edges (weft entry side=selvedge, weft exit side=crochet edge).

Wavy or sabre-like deformed belt webbing can no longer be neatly coiled with the common automatic seat belt retractors and there is the risk that in a crash situation the vehicle occupant with his/her seat belt fastened is displaced too far forwards due to the thus occurring "belt slack" with an enormous added risk of injury.

In the production of vehicle safety belts, particular attention must be paid to good abrasive properties. During the weaving process already, the yarn tension should be uniform over the entire bandwidth from edge to edge.

Above all, both edge regions must have the same properties.

This is very difficult to put into practice, especially with ribbons woven on modern needle weaving looms due to the different edge designs on account of the weaving technique (weft entry side=selvedge, weft exit side=crochet edge).

The thus produced ribbons deform frequently and become wavy or sabre-curved.

Identical edges in terms of weaving are only achieved with pick-and-pick (shuttle) weaving looms. On needle weaving looms, two alternating picks working in opposite directions have to be used, cf. e.g., DE 102 28 066 B4, in order to achieve identical edges in terms of weaving.

This method comprises crocheting the weft loops with so-called auxiliary or catch yarns. The crocheting can be released in the finished woven fabric when the auxiliary yarn is damaged (run effect) if an additional blocking yarn does not secure it.

Thus, this weaving method is complicated and difficult to adjust due to the auxiliary and blocking yarns feeder difficult to adjust. Moreover, both yarns have to be delivered to the weaving spot by a positive yarn transport.

SUMMARY OF INVENTION

The present invention relates to a method for producing on needle weaving looms a woven ribbon, preferably a vehicle safety belt strap, which has the same edges in terms of weaving.

The right and left edges, respectively, alternately have a weft entry and a crocheted weft exit.

Contrary to known weaving methods, the fixing of the picked weft loops is neither carried out with itself nor by so-called auxiliary yarns or catch yarns.

The present invention is characterised in that the fixing of the weft loops at the weft exit side is carried out by the preceding weft yarn picked by the opposite side.

Moreover, a vehicle safety belt strap with monofilament weft yarns and soft edge may be produced. To this end a special weft yarn needle is used into which two weft yarns (multifilament and monofilament) are drawn.

The particular design of the weft yarn needle (having a slot) ensures that only the multifilament yarn is being crocheted and the thus resulting stitch row covers the hard, monofilament weft points of reversing at the edge.

The present invention also discloses the working with two opposing picks or weft needles alternating from right and left. The weft loops, however, are crocheted neither with auxiliary yarns nor themselves.

According to the invention, the weft loops are crocheted with the weft yarn, already fixedly interweaved, and which at this time is idle opposite the weft entry side.

The advantages of the present invention are as follows:

A non-run weft loop fixation and a machine construction which is simpler (cheaper) and easier to adjust. Since it can be done without the high-quality and expensive auxiliary and blocking yarns, the product becomes cheaper and the serviceability of the weaving loom is simplified.

DETAILED DESCRIPTION OF THE INVENTION

Figure 1:
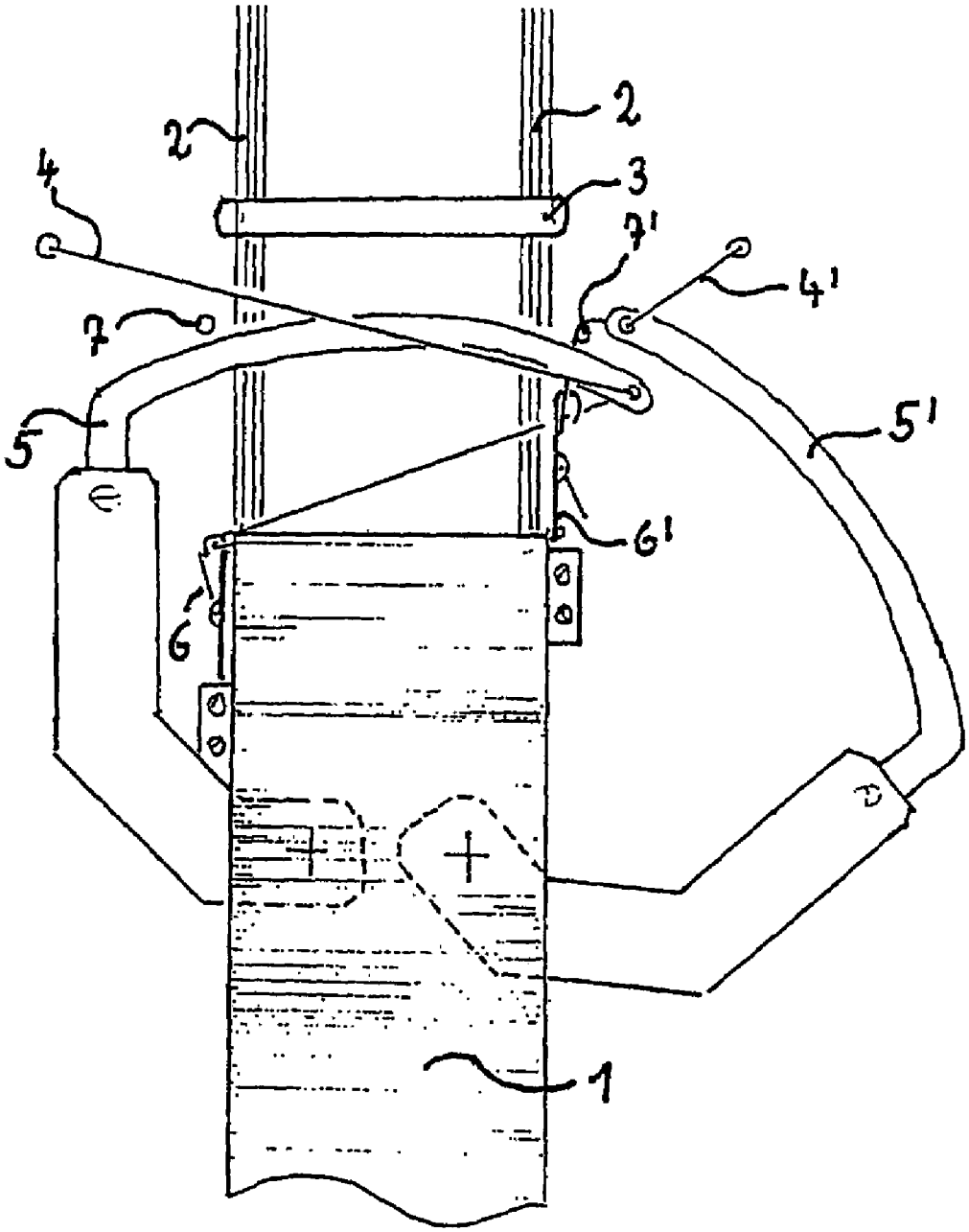
FIG. 1 shows one embodiment of the weaving means of the present invention.

The present invention relates to a method for producing on needle weaving looms a woven ribbon, preferably a vehicle safety belt strap, which has the same edges in terms of weaving. The right and left edges, respectively, alternately have a weft entry and a crocheted weft exit.

Contrary to known weaving methods, the fixing of the picked weft loops is neither carried out with itself nor by so-called auxiliary yarns or catch yarns.

The present invention is characterised in that the fixing of the weft yarn loops at the weft exit side is carried out by the preceding weft yarn picked by the opposite side.

Moreover, a vehicle safety belt strap with monofilament weft yarns and soft edge may be produced. To this end a special weft yarn needle is used into which two weft yarns (multifilament and monofilament) are drawn.

The particular design of the weft yarn needle (slot) ensures that only the multifilament yarn is being crocheted and the thus resulting stitch row covers the hard, monofilament weft yarn points of reversing at the edge.

After the weaving reed (3) is gone back and the shed has been formed by the warp yarns (2), the first weft yarn (4) is picked with the left-hand weft yarn needle (5) from left to right.

At the right-hand edge of the webbing, a horizontally working knitting needle (6') is passed through the thus picked weft yarn loop, the knitting needle (6') taking the weft yarn, depressed by the right-hand yarn gripper (7'), of the opposite right-hand idle weft needle (5') and drawing it to the finished fabric (1).

When the right-hand weft yarn is safely in the hook of the knitting needle, the right-hand yarn gripper is moved upwards and releases the right-hand weft yarn and thus a small yarn reserve which is sufficient to form the loops.

During the backward movement of the left-hand weft yarn needle to the left, the left yarn gripper (7) moves vertically from the top to the bottom and keeps the returning weft yarn in a position which ensures that it can be caught by the left-hand knitting needle (6) at the next pick.

During the downward movement of the yarn gripper, the weft yarn caught by it is slightly pressed downward to ensure that the next pick from the right-hand side is above the already implemented pick.

After the reed beat-up and change of the shed, the second pick is implemented from the right-hand weft needle (5) to the left and is meshed with the first weft yarn provided by the right-hand yarn gripper.

Implementing the third pick as a repeat of the first pick, implementing the fourth pick as a repeat of the second pick etc.

If a woven fabric is to be produced with a monofilament weft yarn for reasons of greater transverse stiffness, as is often the case with the vehicle safety belt, the two weft yarn needles can be replaced by special weft yarn needles in the above described weaving means as follows.

Figure 2:
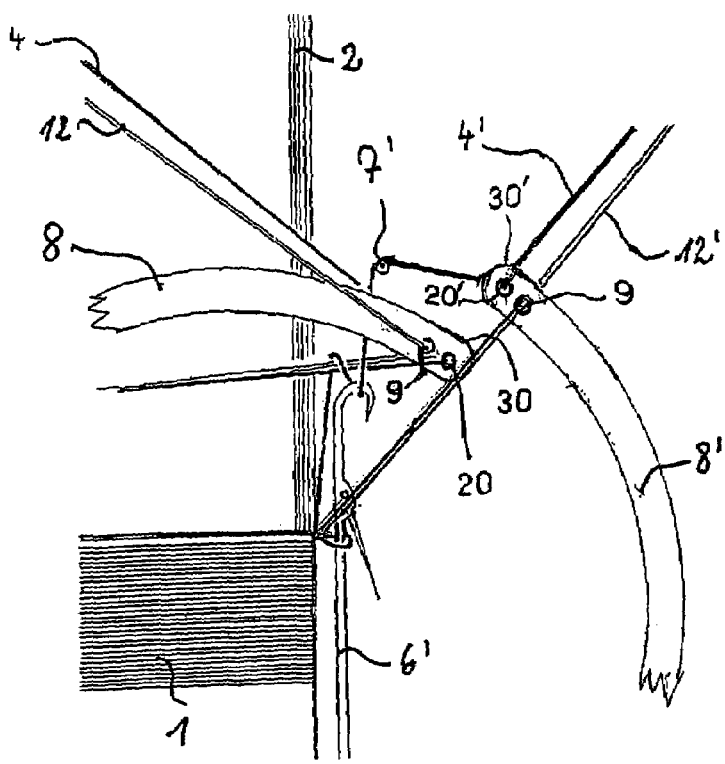
FIG. 2 shows another embodiment of the weaving means of the present invention and illustrating a diagram of the special weft needles as a part of the right side of a weaving spot of the weaving means of the present invention.
Figure 2:
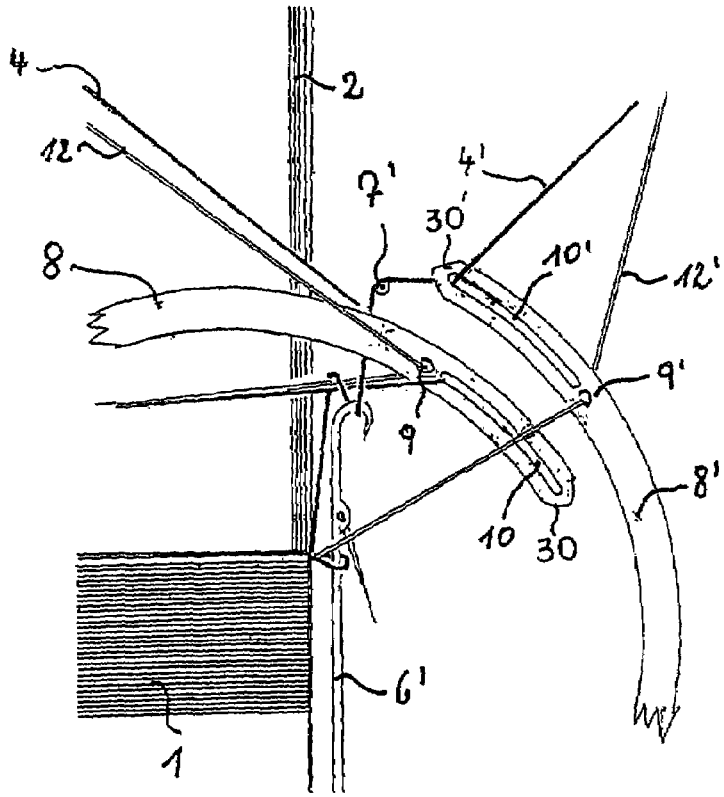

Reference is made to FIG. 2

The specific embodiment of a method for producing Method of producing a woven ribbon with the same edges on needle weaving looms of the present invention will be explained hereunder with reference to the attached drawings FIGS. 2 to 5.

Please note that FIG. 2 shows the diagram of the embodiments of the present invention in which the special weft yarn needles as a part of the right side of a weaving spot are provided.

Especially, FIG. 2 shows one specific embodiment of the present invention, and in that it is apparent that the needle loom as used in this embodiment is provided with a pair of weft yarn needles each having a second yarn eyelet (9,9') through which a monofilament weft yarn (12,12') is drawn in the weft yarn needles (8,8') and additionally provided with a first yarn eyelet (20,20') through which a multifilament weft yarn (4,4') is drawn in the weft needles (8,8').

Further, FIG. 2 (A) shows a several number of warp yarns (2) arranged at a right hand side edge portion of the loom and a knitting needle (6) located at the right hand side of the loom.

On the other hand, a yarn gripper (7') is shown as a point and fabric (1) as produced is also shown in FIG. 2(A). The yarn gripper (7') is only shown as a point. The finished fabric (1) is also only illustrated in outlines.

Figure 3:
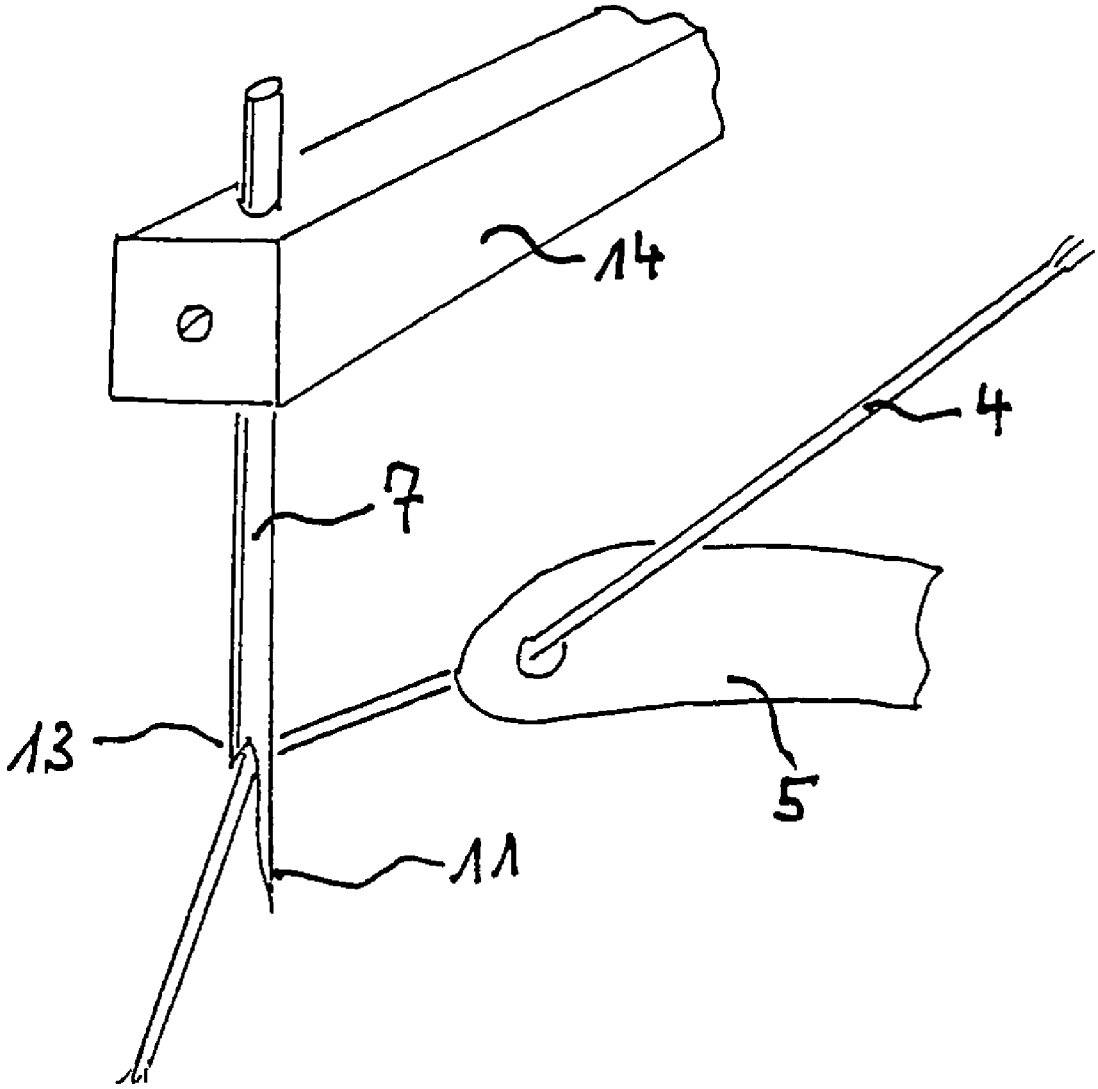
FIG. 3 shows one embodiment of the yarn gripper (7) used in the present invention.

As shown in FIG. 3, one embodiment of the yarn gripper (7) as used in the present invention is schematically shown and the yarn gripper (7) is provided with a tip (11) and a fork (13).

In FIG. 3, further a retainer (14) leading to the frame as well as a tip of the weft needle (5) with the drawn-in weft yarn (4) are also shown.

A yarn gripper like this or a similar one can be driven, as shown in the drawing, by a shank controlled by a special cam disc or by a separate lever also operated by a cam disc.

Figure 4:
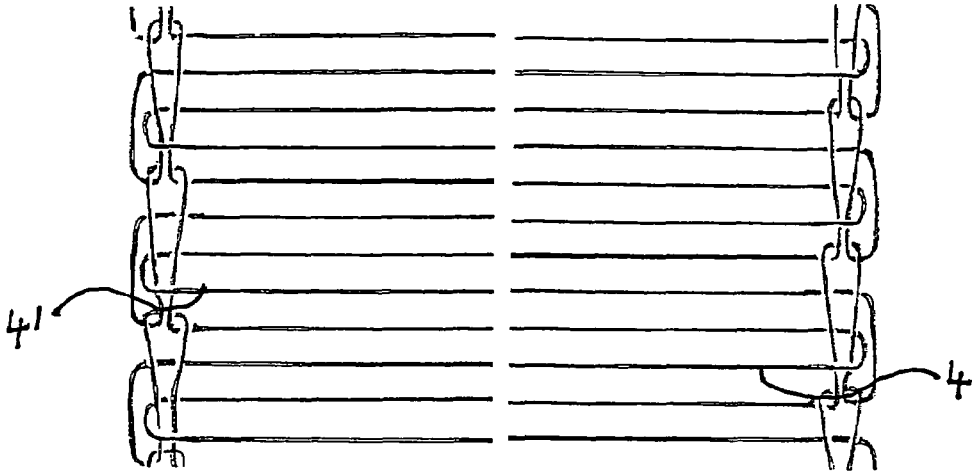
FIG. 4 shows one embodiment of the safety belt of the present invention.

FIG. 4 shows the diagram of the weft crocheting at the edges in a simple fabric. The weft yarn (4) picked from the left is crocheted with the right-hand idle weft yarn (4').

Figure 5:
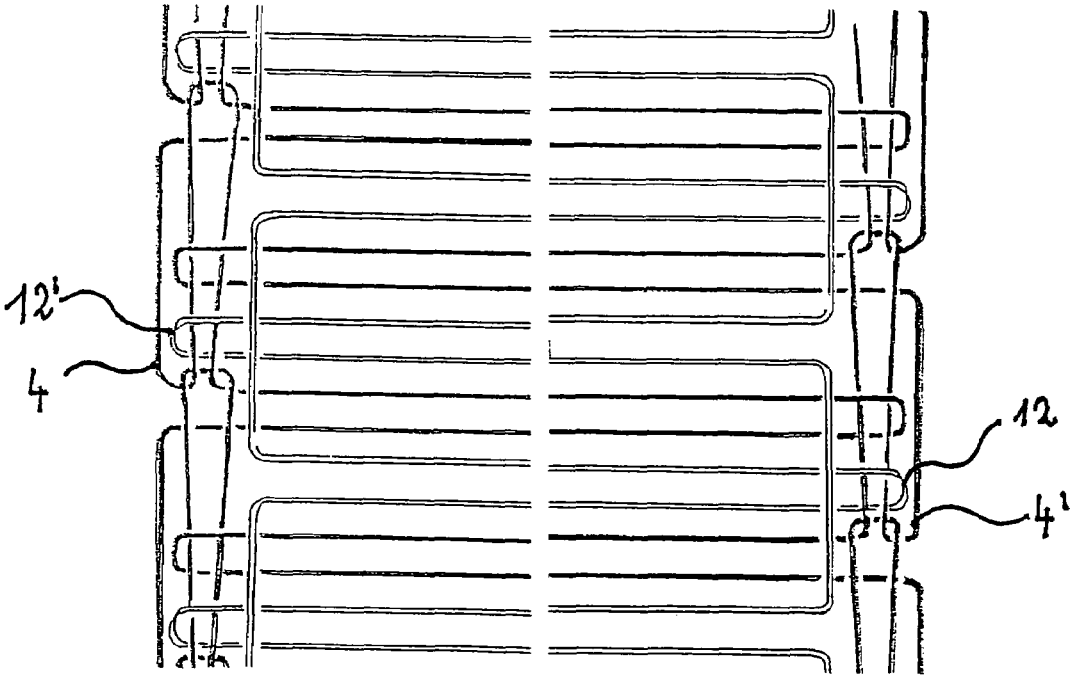
FIG. 5 shows another embodiment of the safety belt of the present invention.

On the other hand, FIG. 5 shows the diagram of the weft crocheting at the edges in a fabric with monofilament and multifilament weft yarns in one weft needle. Only the multifilament yarn (4) is crocheted while the monofilament yarn (12) is only tied in.

The weft yarn needles (8,8') as used in this embodiment, will be explained specifically.

As mentioned above, a needle loom as used in the present invention is provided with a pair of weft yarn needles (8,8) which being provided at both sides of the needle weaving loom and each being alternately picked into the warp yarns from the left hand side and the right hand side of the loom, respectively, and each one of the weft yarn needles is configured so that it can pick two weft yarns simultaneously into the warp yarns in each respective picking operation.

Further, each one of the weft needles is so configured that each one of the weft yarn needles (8,8') can pick both a multifilament yarn (4,4') and a monofilament yarn (12,12'), simultaneously into the warp yarns in one picking operation.

In this embodiment, it is preferable that each one of the weft yarn needles is provided with a first yarn eyelet portion (20, 20') through which the multifilament yarn(4,4') can pass and a second eyelet portion (9,9') through which the monofilament yarn can pass through and further wherein the first eyelet portion (20, 20')is arranged at a position in the vicinity of a tip end portion (30) of the weft yarn needle (8) with respect to a position at which the second eyelet portion (9,9') is arranged.

Next, another embodiment of the present invention will be explained hereunder with reference to the attached FIG. 2(B).

Especially, FIG. 2(B) shows a separate specific embodiment of the present invention, and in that it is apparent that the needle loom as used in this embodiment is provided with a pair of weft yarn needles each having a second yarn eyelet (9,9') through which a monofilament weft yarn (12,12') is drawn in the weft yarn needles (8,8') and additionally provided with a first yarn eyelet (10,10') having a slot like configuration comprising an elongated hole through which a multifilament weft yarn (4,4') is drawn.

Please note that in this embodiment, the first eyelet portion (10,10') for a multifilament yarn has a slot like configuration, a longitudinal axis of which extending along a longitudinal direction of the weft needle.

Note that in the present invention, the method is characterised in that the weft yarn needle with a normal yarn eyelet (hole) and a yarn eyelet formed as slot (elongated hole) is used.

And further note that the method of the present invention is characterised in that the weft yarn drawn into the normal yarn eyelet (hole), is a monofilament yarn.

In this embodiment, it is also preferable that each one of the weft yarn needles is provided with a first yarn eyelet portion having a slot like configuration (10, 10') through which the multifilament yarn(4,4') can pass and a second eyelet portion (9,9') through which the monofilament yarn can pass through and further wherein the first eyelet portion (10, 10')is arranged at a position in the vicinity of a tip end portion (30) of the weft yarn needle (8) with respect to a position at which the second eyelet portion (9,9') is arranged.

In this embodiment, the slot (10, 10') has such a length that upon returning of the weft needle and picking of the yarn gripper (7'), the multifilament yarn may glide up to the forward end of the slot and thus is certainly caught by the knitting needle (6').

However, the monofilament in the yarn eyelet is drawn away from the crochet position so far that it is not caught by the knitting needle but only picked from below.

Thus, a fabric is made, wherein only the soft multifilament yarn is crocheted and covers the hard monofilament points of reversing with the thus created stitch row.

In one embodiment of the present invention, as shown in FIG. 1, one specific embodiment of the weaving means as used in the present invention is shown and in which it is provided with two opposed, alternating weft needles (5,5') and the warp yarns (2,2') are only outlined at the edge of the fabric.

And further, in FIG. 1, the weaving reed (3) as well as the weft yarns (4,4') are also illustrated.

Moreover, the right-hand and left-hand knitting needles (6,6') are shown. For the sake of clarity, the yarn grippers (7,7') are only shown as points and illustrated separately in FIG. 3. The finished fabric is denominated as (1).

On the other hand, FIG. 2 (B) shows the diagram of another embodiment of the present invention in which the special weft needles as a part of the right side of a weaving spot are provided.

As shown in FIG. 2, the two weft yarn needles (8,8') with the yarn eyelets (9,9') for the monofilament yarn (12,12') and the slots (10,10') for the multifilament weft yarn (4,4') are provided and further, the warp yarns of the right edge (2) and the right-hand knitting needle (6') are shown.

The yarn gripper (7') is only shown as a point. The finished fabric (1) is also only illustrated in outlines.

As shown in FIG. 3, one embodiment of the yarn gripper (7) as used in the present invention is schematically shown and the yarn gripper (7) is provided with a tip (11) and a fork (13).

In the present invention, a vehicle safety belt woven with a needle weaving looms utilizing warp yarns and weft yarns with the same edges made by crochet stitch on both sides thereof can be obtained and in the vehicle safety belt, both of a monofilament yarn and a multifilament yarn being used as the weft yarns in one pick and further wherein the edge being formed only by the multifilament yarn.

What is claimed is:

1. A method for producing a woven ribbon, preferably a vehicle safety belt strap, characterized in that the weft yarns alternately picked from right and left are crocheted with the respective preceding weft already picked, and providing a pair of weft needles at both sides of said needle weaving loom and each are alternately picked into the warp yarns from the left hand side and the right hand side of said loom, respectively, and each one of said weft needles is configured so that it can pick two weft yarns simultaneously into said warp yearns in each respective picking operation.

2. A method according to claim 1, characterized in that the respective preceding weft yarn, used as crochet yarn, is presented by a yarn gripper such that it is caught by the knitting needle which goes through the just picked weft loop, and is released again after being safely in the hook of the knitting needle.

3. A method according to claims 1 or 2, characterized in that a fabric can be produced with two weft yarns per weft needle, wherein only one weft yarn is crocheted.

4. A method according to claim 1, wherein each one of said weft needles is so configured that each one of said weft yarn needles can pick both a multifilament yarn and a monofilament yarn, simultaneously into said warp yarns in one picking operation.

5. A method according to claim 1, wherein each one of said weft yarn needles is provided with a first yarn eyelet portion through which said multifilament yarn can pass and a second eyelet portion through which said monofilament yarn can pass through and further wherein said first eyelet portion is arranged at a position in the vicinity of a tip end portion of said weft yarn needle with respect to a position at which said second eyelet portion is arranged.

6. A method according to claim 4, wherein said first eyelet portion for a multifilament yarn has a slot like configuration, a longitudinal axis of which extends along a longitudinal direction of said weft needle.

7. A method according to claims 1 or 2, wherein said method is characterized in that said weft needle with a normal yarn eyelet and a yarn eyelet formed as a slot is used.

8. A method according to claims 1 or 2, wherein the weft yarn drawn into a normal yarn eyelet is a monofilament yarn.

9. A vehicle safety belt woven with needle weaving looms utilizing warp yarns and weft yarns with the same edges made by a pair of weft yarn needles that are provided at both sides of said needle weaving loom and each of said needles are alternately picked into the warp yarns from the left hand side and the right hand side of said loom, respectively, and each one of said weft needles is configured so that it can pick two weft yarns simultaneously into said warp and wherein both of a monofilament yarn and a multifilament yarn are used as said weft yarns in one pick and further wherein said edges are formed only by said multifilament yarn.

* * * * *